US007304270B2

(12) United States Patent
Fisher

(10) Patent No.: US 7,304,270 B2
(45) Date of Patent: Dec. 4, 2007

(54) INTEGRATED WARMER DRAWER AND WARMER ZONE CONTROLS

(75) Inventor: Gary Fisher, Goodlettsville, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 167 days.

(21) Appl. No.: 10/821,362

(22) Filed: Apr. 9, 2004

(65) Prior Publication Data

US 2004/0262285 A1 Dec. 30, 2004

Related U.S. Application Data

(60) Provisional application No. 60/461,926, filed on Apr. 10, 2003.

(51) Int. Cl.
*F24C 7/00* (2006.01)
*H05B 1/02* (2006.01)

(52) U.S. Cl. ..... 219/398; 219/396; 219/412; 219/480; 219/485

(58) Field of Classification Search ..... 219/477
See application file for complete search history.

(56) References Cited

U.S. PATENT DOCUMENTS 1,936,464 A * 11/1933 Wey ..... 219/477
2,279,525 A * 4/1942 Rogers ..... 219/485
3,125,659 A * 3/1964 Welch ..... 219/398
4,849,597 A * 7/1989 Waigand ..... 219/414
5,280,157 A * 1/1994 Hornung ..... 219/397
5,611,327 A * 3/1997 Teixeira Filho et al. .. 126/39 R
5,990,454 A * 11/1999 Westerberg et al. ..... 219/412
6,021,774 A 2/2000 Taplan et al.
6,148,812 A 11/2000 Taplan et al.
6,166,353 A 12/2000 Senneville et al.
6,191,391 B1 * 2/2001 Deo et al. ..... 219/407
6,198,080 B1 * 3/2001 Rice et al. ..... 219/506
6,410,891 B1 6/2002 Muskalla et al.
6,492,622 B2 12/2002 Melson et al.
6,528,772 B1 3/2003 Graves et al.
6,555,794 B2 4/2003 Leutner et al.
6,570,135 B2 5/2003 Gros et al.
6,570,136 B1 * 5/2003 Lockwood et al. ..... 219/398
6,809,301 B1 * 10/2004 McIntyre et al. ..... 219/506
6,949,723 B2 * 9/2005 Staebler et al. ..... 219/445.1
2002/0190057 A1 * 12/2002 Staebler et al. ..... 219/506
2003/0015518 A1 * 1/2003 Baker et al. ..... 219/486
2005/0173401 A1 * 8/2005 Bakanowski et al. ..... 219/412

FOREIGN PATENT DOCUMENTS

DE 3516464 A1 * 11/1986
GB 2252647 A * 8/1992

* cited by examiner

*Primary Examiner*—Joseph Pelham
(74) *Attorney, Agent, or Firm*—Pearne & Gordon LLP

(57) ABSTRACT

A range for heating foods having a body comprising a top surface, a first chamber located within the range, a second chamber located within the range, multiple heating elements arranged on the top surface for cooking food, an upper and lower heating element arranged within the first chamber, a warming element arranged within the second chamber, a control system further having a central processor for controlling the operation of the range, and an operator interface operatively connected to the central processor.

28 Claims, 6 Drawing Sheets

INTEGRATED WARMER DRAWER AND WARMER ZONE CONTROLS

This application claims the benefit of U.S. Provisional Patent Application Ser. No. 60/461,926 filed Apr. 10, 2003, the contents of which are incorporated herein by reference.

FIELD OF INVENTION

The present invention relates to cooking ranges and, more particularly to a cooking range having a warmer drawer and warmer zone electronically controlled by a centralized processor.

BACKGROUND OF THE INVENTION

Traditionally cooking ranges consisted of a number of surface burners for cooking, boiling, steaming, flying, etc. food and an oven for baking or broiling food. The burners, although had settings ranging from low to hi, were either on or off. Even if the burners were set to low, the constant low heat being transferred to the food would continue to cook the food. A need therefore existed for a food warming zone located on the surface. Although this need has been addressed as there are ranges that presently have a warmer zone these ranges require separate processors to perform the functions of the surface burners, oven and warmer zone.

Typical ranges further consisted of a storage drawer located beneath the oven. The storage drawer was utilized to store various cooking utensils such as a broiling pan, cookie sheets, etc. In addition, the storage drawer has also been utilized as a broiling chamber that received a broiling tray. The broiling element was located above the broiling tray and was operated at high temperatures to perform the broiling function. Because the broiling element operated at only high temperatures any attempt to maintain the temperature of the food without further cooking it was not possible.

Therefore, a need existed for a warming function to maintain food at a warm temperature without further cooking the food. U.S. Pat. No. 6,191,391 to Deo et al. discloses a warming drawer for a domestic range located beneath the oven. The temperature of warmer drawer heating element is maintained between a predetermined maximum and minimum temperature so as to provide warmth to the warmer drawer thereby keeping the food warm without further cooking it. However, the disadvantage of Deo et al. is that the warmer drawer, like the warmer zone, required a separate processor to process the functions input by the operator.

Therefore, a need exists for a cooking range that has surface burners, a warmer zone, an oven, and a warmer drawer that perform distinct cooking functions and are all controlled by a centralized processing control system having a single processor.

BRIEF SUMMARY OF THE INVENTION

The present invention overcomes the aforementioned disadvantages by providing in one aspect a range unit for heating foods for consumption where the unit includes at least one range-top heating means, a first range-chamber heating means for heating a first range-chamber, a second range-chamber heating means for heating a second range-chamber, and an electronic control means having a central processor operatively connected to the range-top heating means, and the first and second range-chamber heating means, for controlling the operation of the range.

In accordance with another aspect the present invention provides a range unit for preparing foods comprising, a body having a top surface, a first chamber located within the range, a second different chamber located within the range, a first heating means arranged on the top surface, wherein the first heating means provides a first type of heating, a second heating means arranged on the top surface, wherein the second heating means provides a second type of heating, a third heating means associated with the first chamber, wherein the third heating means provides a third type of heating, a fourth heating means associated with the second chamber, wherein the fourth heating means provides a fourth type of heating, an electronic control means having an operator interface, a central processor, means for operatively connecting the operator interface to the centralized processor for the purpose of communicating with the centralized processor, and means for operatively connecting the centralized processor with the first, second, third and fourth heating means for the purpose of communicating with the heating means.

In accordance with yet another aspect the present invention provides a range for heating foods having a body further comprising a top surface, a first chamber located within the range, a second chamber located within the range, a plurality of heating elements arranged on the top surface for cooking food, an upper and lower heating element arranged within the first chamber, a warming element arranged within the second chamber, a control system having a central processor for controlling the operation of the range; and, an operator interface operatively connected to the central processor.

In accordance with still yet another aspect the present invention provides a method of operating a range comprising the steps of providing a body comprising a top surface, a first chamber located within the range, a second different chamber located within the range, a first heating means arranged on the top surface, wherein the first heating means provides a first type of heating, a second heating means arranged on the top surface, wherein the second heating means provides a second type of heating, a third heating means associated with the first chamber, wherein the third heating means provides a third type of heating, a fourth heating means associated with the second chamber, wherein the fourth heating means provides a fourth type of heating, an electronic control means comprising, an operator interface, a centralized processor, means for operatively connecting the operator interface to the centralized processor for the purpose of communicating with the centralized processor; and, means for operatively connecting the centralized processor with the first, second, third and fourth heating means for the purpose of communicating with the heating means, pressing a control button on the operator interface, transmitting information to the central processing unit, processing the information received from the operator interface through the central processing unit, and turning on a heating means.

Additional benefits and advantages of the present invention will become apparent to those skilled in the art to which it pertains upon a reading and understanding of the following detailed specification.

BRIEF DESCRIPTION OF THE DRAWINGS

The invention may take physical form in certain parts and arrangement of parts, an example of which will be described in detail in this specification and illustrated in the accompanying drawings that form a part of the specification.

DESCRIPTION OF AN EXAMPLE EMBODIMENT

Figure 1:
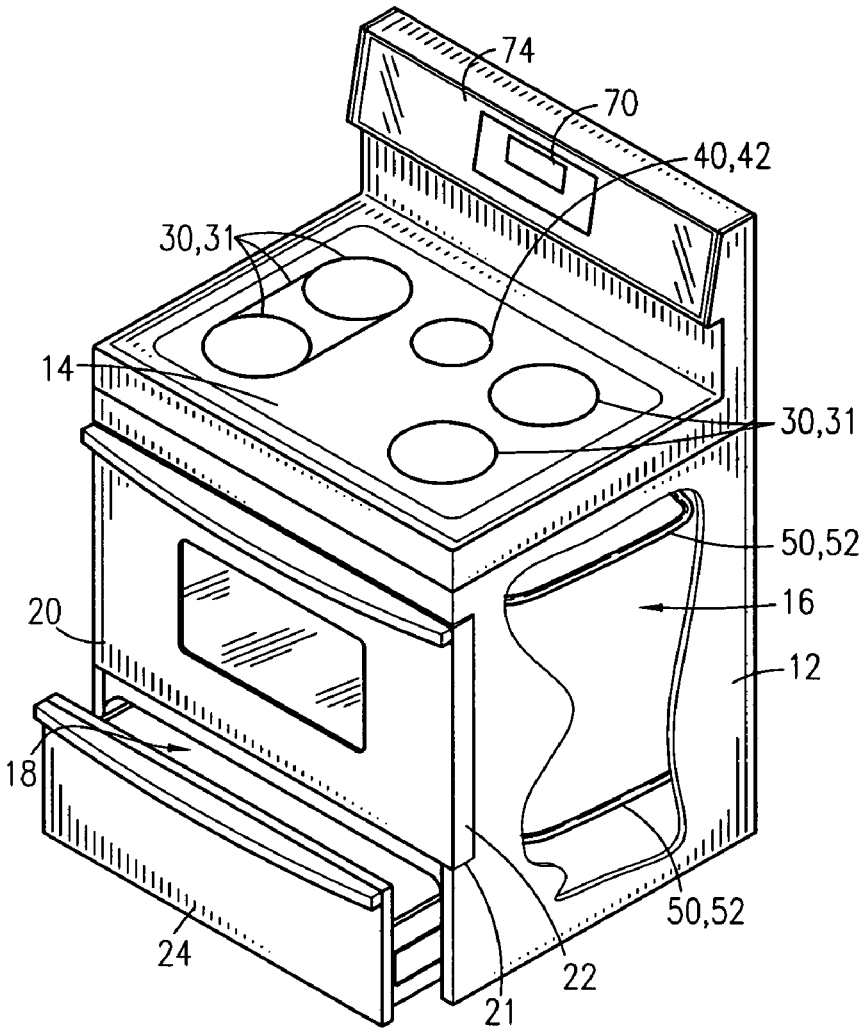
FIG. 1 is a perspective view of a cooking range showing the location of a warmer drawer and a warmer zone.

Referring now to the drawings, which are for purpose of illustrating an example of the invention only and not for purpose of limiting the same, FIG. 1 shows a front view of a typical range 10 that incorporates an integrated electronic control system in accordance with this invention. The range comprises a body 12, a top surface 14, a first chamber 16 located under the top surface 14, and a second chamber 18 located under the first chamber 16. A door 20 is hingedly attached to the front 22 of the body 12 at the bottom edge of the first chamber 16 and encloses the first chamber 16 when in a closed position. A drawer 24 is slidably positioned in the second chamber 18. The range 10 further consists of a user interface 70 located on the back panel 74 of the range.

Figure 5:
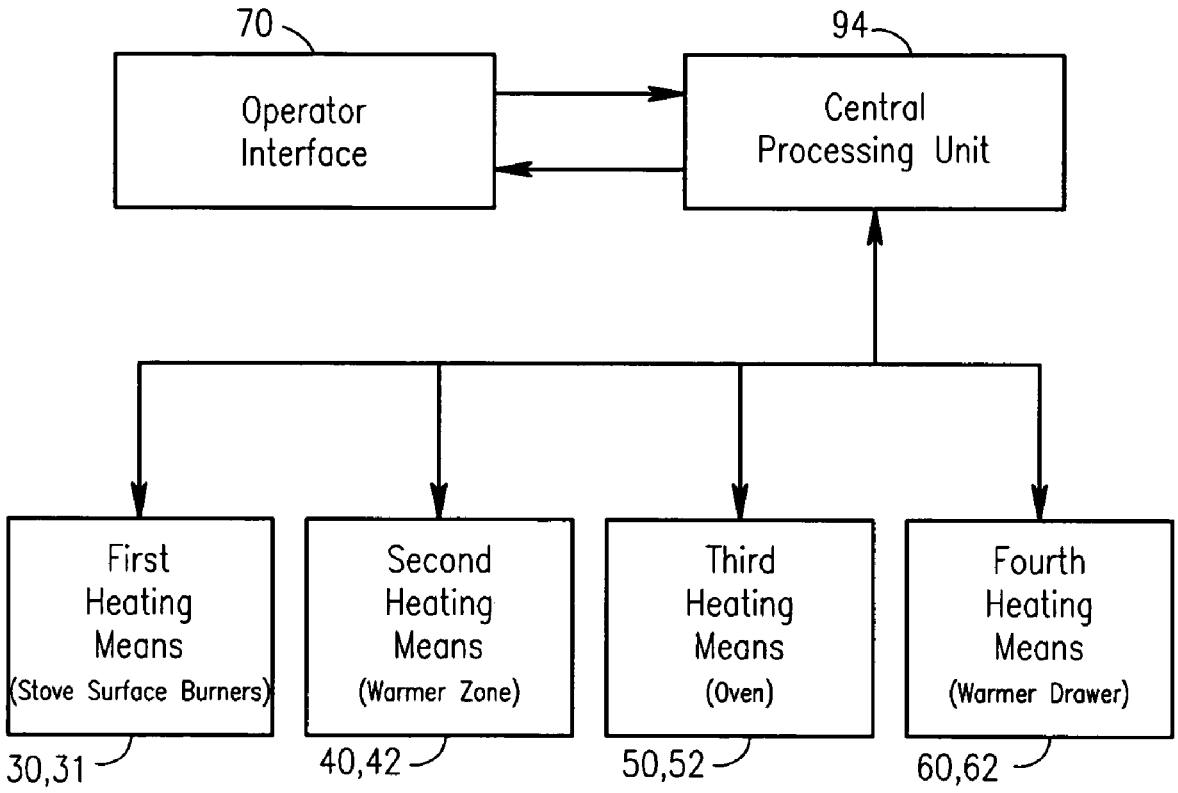
FIG. 5 is a functional block diagram showing portion of a control system communication.

Still referring to FIG. 1 and to FIG. 5, the range 10 further comprises multiple heating means wherein each heating means provides a separate type of heating. A first heating means 30 is located on the top surface 14 and may comprise a plurality of heating elements 31 such as a left rear burner, a left front burner, a right front burner, a right rear burner, and a bridge burner. The heating elements 31, can be any type of heating element such as elements known or available in the art. One example is an electrical resistive thermal device. The heating elements 31 can be positioned on the top surface 14 in any arrangement. In the example embodiment the heating elements 31 are positioned near each corner of the top surface 14 with the bridge burner connecting the left rear left front burners as shown in FIG. 1. The first heating means 30, being arranged on the top surface 14, typically interfaces with bottoms of a cooking utensils (not shown) such as pots or pans for cooking food. Cooking food includes but is not limited to any type of cooking foods such as frying, boiling, steaming, grilling, baking, roasting, broiling, etc. food.

A second heating means 40 is also located on the top surface 14 and further comprises at least one heating element 42 that functions as a warmer zone. In the example embodiment the second heating means 40 has one heating element 42. However, the second heating means 40 may consist of multiple heating elements 42. The heating element 42, can be any type of heating element such as elements known or available in the art. One example is an electrical resistive thermal device. The second heating means 40 can be positioned in any arrangement in conjunction with the first heating means 30. In the example embodiment, the second heating means 40 is positioned near the back middle portion of the top surface 14 as shown in FIG. 1. The second heating means 40, being arranged on the top surface 14, interfaces with bottoms of cooking utensils (not shown) such as pots or pans to provide a cyclic warming temperature to the food. The cyclic warming temperature will be described in further detail below.

A third heating means 50 is associated with the first chamber 16 and may comprise a plurality of heating elements 52 such as a lower heating element for baking and an upper heating element for broiling such as in oven. The heating elements 52 can be any type known or available in the art. One example is a tubular, electrical resistance-type heating element. The heating means 50 serves three distinct functions within the first chamber 16. The upper and lower elements are used to cook foods and more specifically; 1) the upper heating element is used to broil foods, 2) the lower heating element is used to bake or roast foods, and 3) the heating means 50 is used to clean the first chamber 16.

Figure 2:
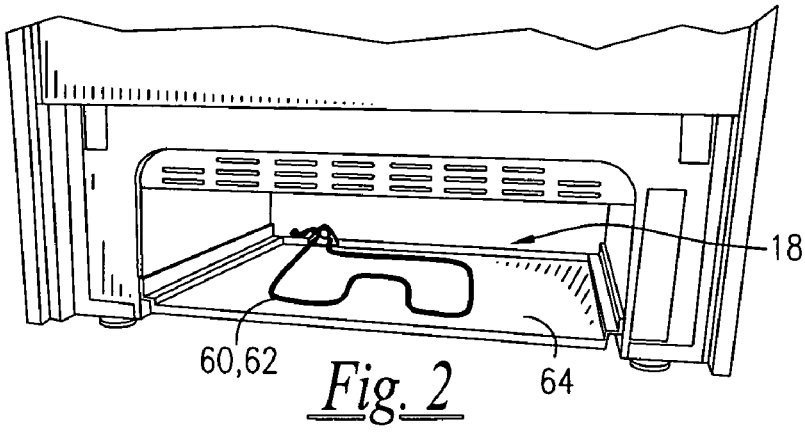
FIG. 2 is a front elevational view of the lower portion of the range with the warmer drawer removed showing the location of the heating element.

Referring to FIG. 2, a fourth heating means 60 further comprises at least one heating element 62. In the example embodiment the fourth heating means 60 has one heating element 62. However, the fourth heating means 60 may consist of multiple heating elements. The heating elements 62 can be any type known or available in the art. One example is a tubular, electrical resistance-type heating element. The fourth heating means 60 is operatively connected to the lower portion 64 of the second chamber 18 and rests below the drawer 24. As previously mentioned the drawer 24 is capable of sliding into and out of the second chamber 18. The fourth heating means 60 in combination with the drawer 24 provide three functions within the second chamber 18. First, the combination serves as a warmer drawer where the heating means provides a cyclic warming temperature to the food inside the drawer 24, second, the combination serves as a bread proofing drawer where the heating means maintains a constant low temperature to allow dough to rise within the drawer 24, and third, the drawer 24 also serves as a storage drawer.

Figure 3:
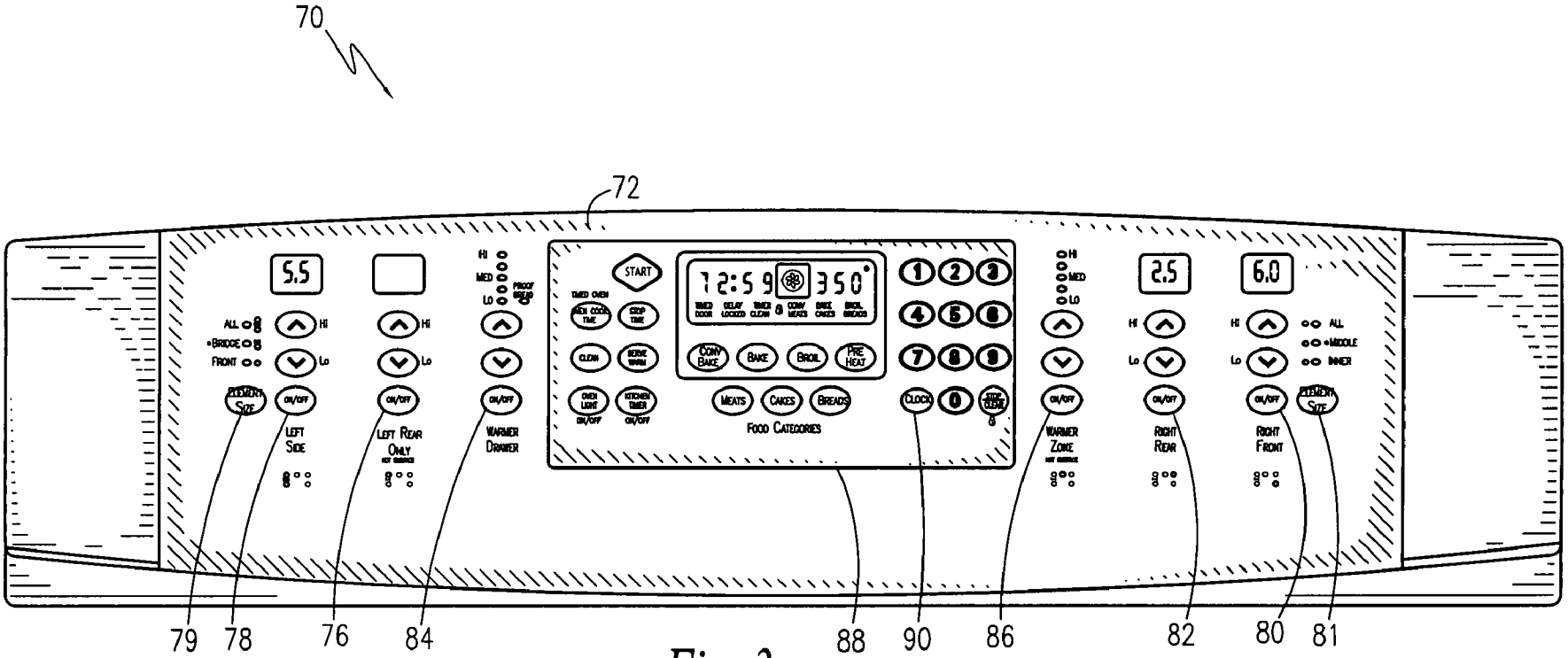
FIG. 3 is a front view of the integrated user interface control panel.

FIG. 3 shows the front view of the operator interface 70. The operator interface 70 can be any type of electromechanical control device known or available in the art. In the example embodiment the operator interface 70 is a glass capacitive touch control pad. The operator interface 70 is positioned on a back panel 74 of the range 10 as shown in FIG. 1. The operator interface 70 comprises a plurality of touch control buttons to control the previously described heating means. More specifically, the operator interface 70 includes left rear control buttons 76 that correspond with the left rear burner, left side 78 and element size 79 control buttons that correspond with the left rear burner, the left front burner, and the bridge burner, right front 80 and element size 81 control buttons that correspond with the right front burner, and right rear control buttons 82 that correspond with the right rear burner. The operator interface 70 further comprises warmer drawer control buttons 84, warmer zone control buttons 86, oven control buttons 88, and a clock control button 90. As previously mentioned the operator interface 70 serves as the interface to communicate between the operator and the central processor as will be subsequently described.

Figure 4:
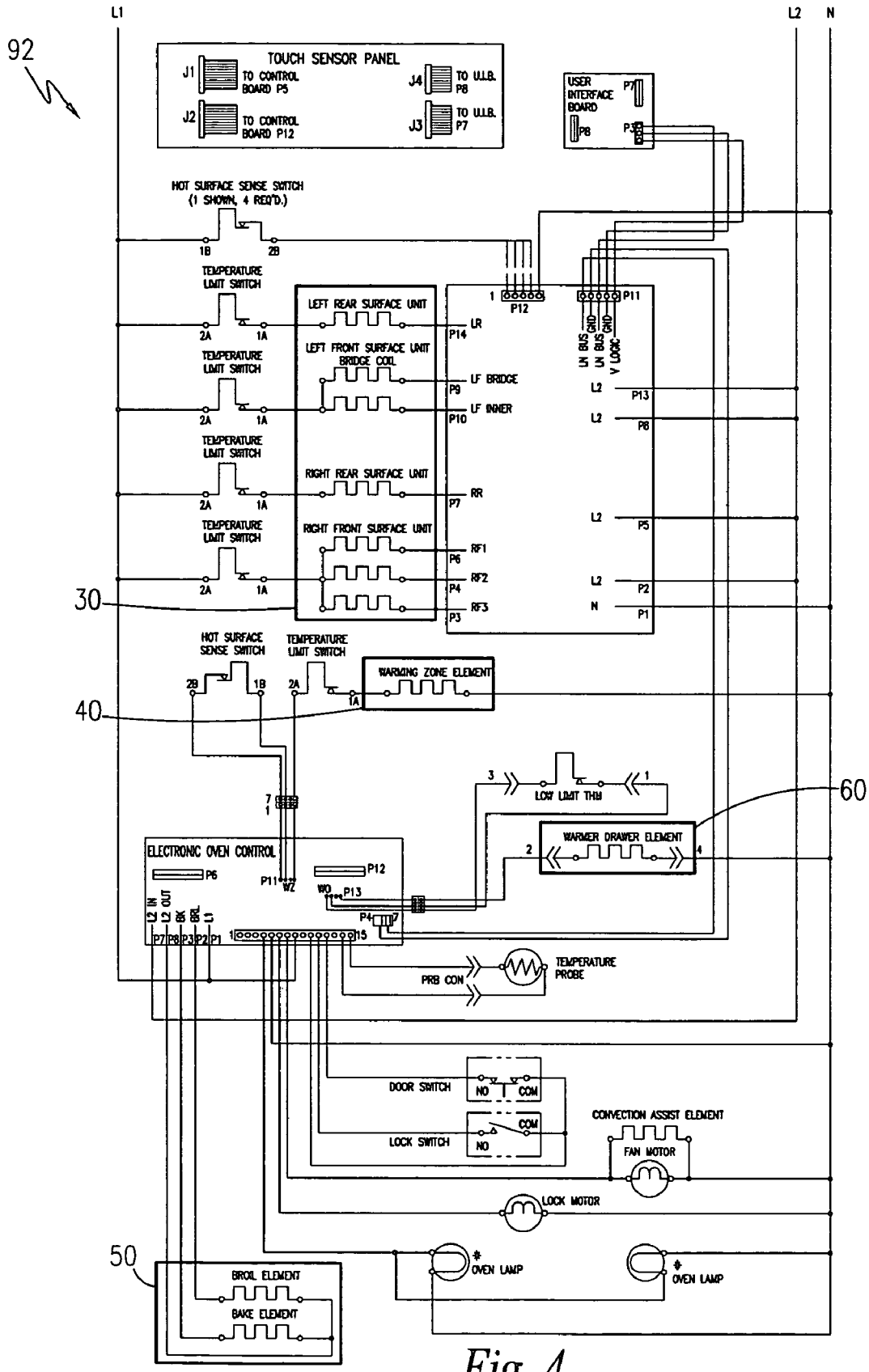
FIG. 4 is a schematic drawing showing the integrated control circuit.

FIGS. 4 and 5 show examples of a configuration and the operation of the integrated control circuit 92. Some generic functions of the circuit 90 are similar to functions of known cooking range controllers and will not be described herein. However, as previously mentioned, prior art control systems required multiple processors to operate the four separate heating means described above. In the present invention one central processing unit 94 operates the four heating means independently of each other. Further. Although the single central processing unit 94 operates the four heating means, the operation may specifically include independent operation of the four heating means.

As illustrated in FIG. 5 the operator interface 70 transmits and receives data to and from a central processing unit 94. The central processing unit 94 in turn processes the data received from the operator interface 70 and performs the specified operation. Depending on the operation chosen by the operator the central processing unit 94 will operate any one or all of the first 30, second, 40, third 50 or the fourth 60 heating means. In one respect, the central processing unit 94 operates the four heating means independently of each other. However, depending on the specified function input from the operator the operation of each heating means is also dependent on the present function of another heating means. For example, when the third heating means 40 is in the cleaning mode the central processing unit 94 will lock out the operation of the remaining three heating means 30, 40, and 60.

It should be noted that the second 40 and fourth 60 heating means operate on a duty cycle. The duty cycle controls the amount of time the heating means 40, 60 are on for a given cycle. The duty cycle is chosen by the operator through the operator interface 70. The duty cycle can range from low to high. The higher the duty cycle the longer the heating means 42, 62 remains on during the cycle.

Figure 6:
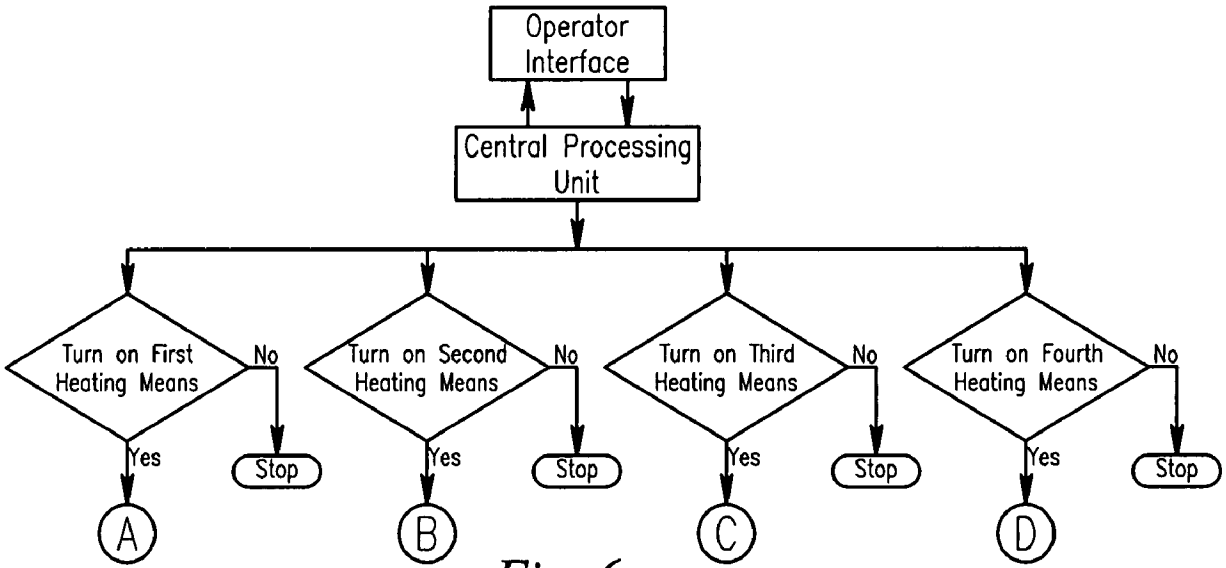
FIGS. 6-10 are flowcharts showing the process steps executed to operate any one of four heating means.
Figure 7:
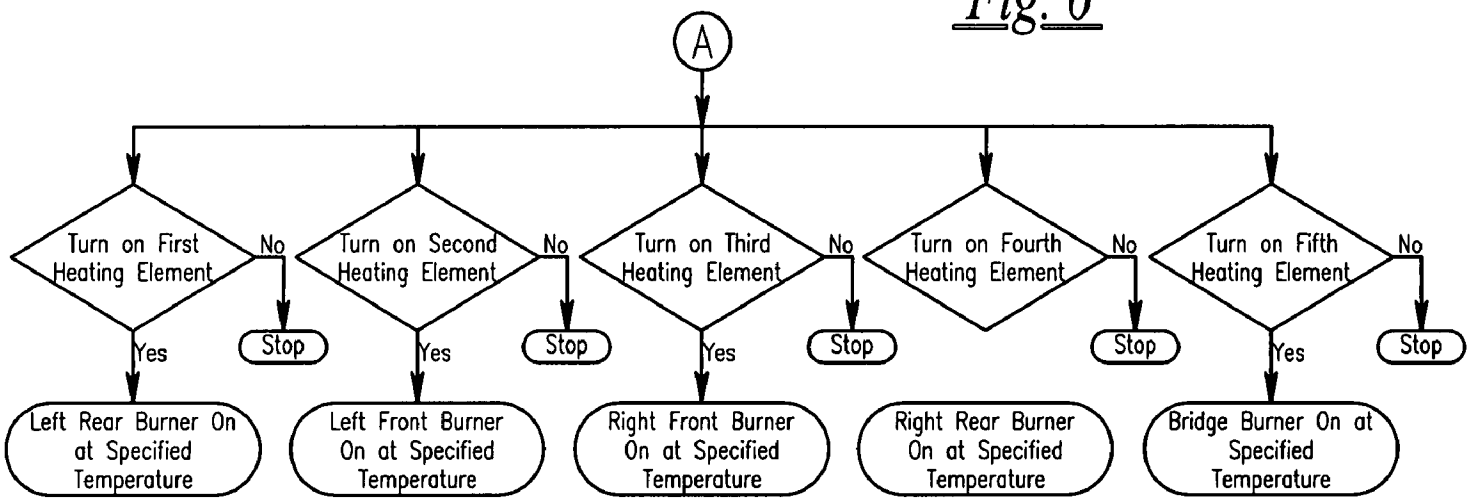
Figure 8:
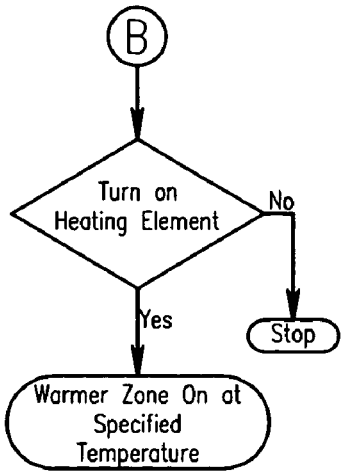
Figure 9:
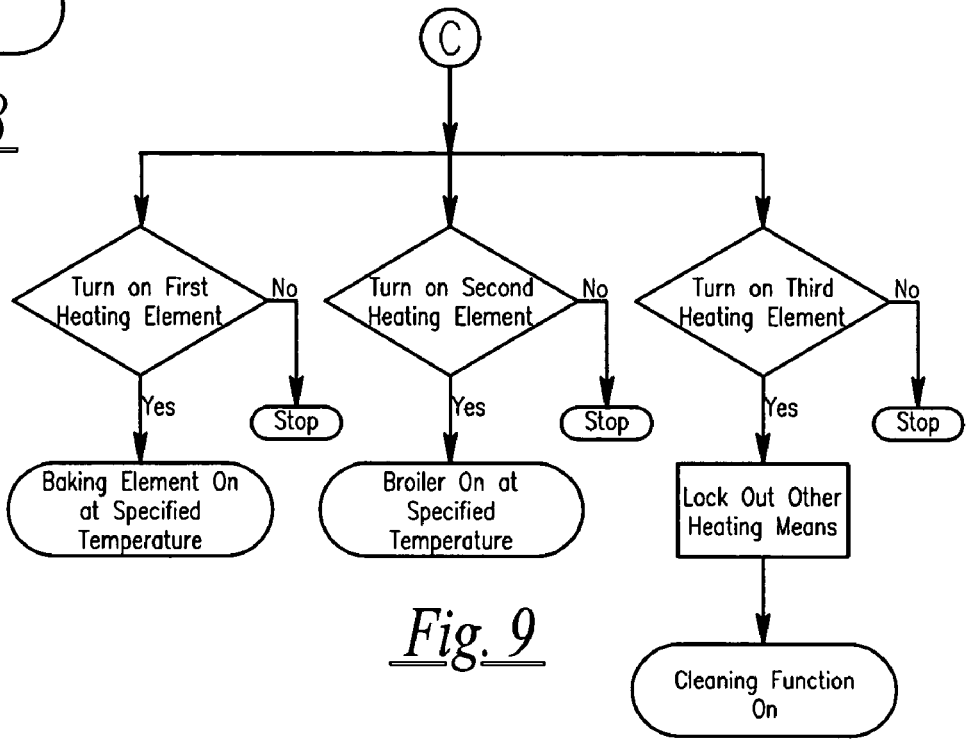
Figure 10:
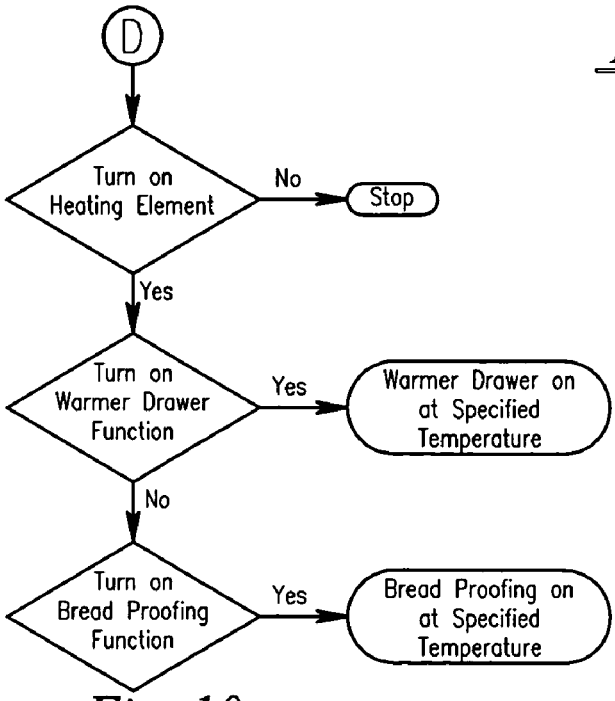

FIGS. 6-10 are flowcharts illustrating the process steps executed during operation of the range 10. The operator begins the process by activating a function by pressing a control button on the operator interface 70. The central processing unit 94 processes the information and turns on one of four heating means 30, 40, 50, or 60 as shown in FIG. 6. If an input request is to activate a portion of the first heating means 30 the central processing unit 94 processes the information to determine which heating element 31 to turn on as shown in FIG. 7. If an input request is to activate the second heating means 40 the warmer zone will turn on at the specified temperature as shown in FIG. 8. FIG. 9 shows the operation for the third heating means 50. If an input request is to activate third heating means the central processing unit 94 processes the information to determine if the lower heating element, the upper heating element, or the cleaning function will be turned on. Note that prior to turning on the cleaning function the central processing unit 94 locks out the operation of the remaining three heating means 30, 40, and 60. Referring to FIG. 10 if an input request is to activate the fourth heating means 60 the central processing unit 94 determines if the warmer drawer or the bread proofing should be turned on. It should be noted that the "Turn on Warmer Drawer Function" and the "Turn on Bread Proofing Function" steps can be reversed.

While specific embodiments of the invention have been described and illustrated, it is to be understood that these embodiments are provided by way of example only and that the invention is not to be construed as being limited thereto but only by proper scope of the following claims.

What is claimed is:

1. A range unit for heating foods for consumption, the unit including:

at least one range-top heating means;

a first range-chamber heating means for heating a first range-chamber;

a second range-chamber heating means for heating a second range-chamber; and, an electronic control means having a central processor operatively connected to the range-top heating means, and the first and second range-chamber heating means, for controlling the operation of each of the at least one range-top heating means, the first range-chamber heating means, and the second range-chamber heating means, wherein the at least one range-top heating means includes a first warming element that operates on a duty cycle and the second range-chamber heating means includes a second warming element that operates on a duty cycle, and wherein the electronic control means is configured to operate the a least one range-top heating means, the first range-chamber heating means, and the second range-chamber heating means both independently of each other and dependently of each other.

2. The range unit of claim 1, wherein the electronic control means further comprises an operator interface operatively connected to the central processor.

3. The range unit of claim 2, wherein the at least one range-top heating means further comprises:

a plurality of heating elements for cooking food.

4. The range unit of claim 3, wherein the plurality of heating elements further comprise:

a left rear burner;

a left front burner;

a right front burner;

a right rear burner; and, a bridge burner; and, wherein the warming element further comprises a warming zone.

5. The range unit of claim 1, wherein the first range-chamber heating means further comprises an upper and lower heating element, wherein the upper heating element is used to broil food and the lower element is used to bake or roast food.

6. The range of claim 1, wherein a heat intensity setting of the duty cycle is controlled by the central processor.

7. The range of claim 1, wherein each of the range-top heating means is coupled to a temperature limit switch.

8. The range of claim 1, wherein the central processor receives information from a hot surface sensor coupled to a temperature limit switch.

9. The range of claim 1, further comprising a door lock switch, the door lock switch configured to prevent power to each of the range-top heating means and the second range-chamber heating means when activated.

10. A range unit for preparing foods comprising:

a body comprising;

a top surface;

a first chamber located within the range;

a second different chamber located within the range;

a first heating means arranged on the top surface, wherein the first heating means provides a first type of heating;

a second heating means arranged on the top surface, wherein the second heating means provides a second type of heating;

a third heating means associated with the first chamber, wherein the third heating means provides a third type of heating;

a fourth heating means associated with the second chamber, wherein the fourth heating means provides a fourth type of heating;

an electronic control means comprising:

an operator interface;

a central processor;

means for operatively connecting the operator interface to the centralized processor for the purpose of communicating with the centralized processor; and, means for operatively connecting the centralized processor with the first, second, third and fourth heating means for the purpose of communicating with the heating means, wherein the fourth heating means operates on a duty cycle, wherein the electronic control means is configured to operated the four heating means both dependently and independently of each other.

11. The range unit of claim 10, wherein the first heating means further comprises a plurality of heating elements for cooking food.

12. The range unit of claim 11, wherein the plurality of heating elements further comprise:

a left rear burner;

a left front burner;

a right front burner;

a right rear burner; and a bridge burner.

13. The range unit of claim 10, wherein the second heating means further comprises at least one heating element for maintaining food at a constant temperature.

14. The range unit of claim 10, wherein the third heating means further comprises an upper and lower heating element, wherein the upper heating element is used for broiling food and the lower heating element is used for baking and roasting food.

15. The range unit of claim 10, wherein the fourth heating means further comprises at least one heating element for maintaining food at a constant temperature.

16. The range unit of claim 15, wherein the second different chamber is a warmer drawer.

17. A range for heating foods comprising:

a body further comprising:

a top surface;

a first chamber located within the range;

a second chamber located within the range;

a plurality of heating elements arranged on the top surface for cooking food;

an upper and lower heating element arranged within the first chamber;

a warming element arranged within the second chamber, wherein the warming element operates on a duty cycle;

a control system further comprising:

a single central processor for controlling the operation of the range each of the plurality of heating elements arranged on the top surface , the upper and lower heating elements arranged within the first chamber, and the warming element arranged within the second chamber; and, an operator interface operatively connected to the central processor, wherein the control system is configured to operate each of the plurality of heating elements both independently and dependently of each other.

18. The range unit of claim 17, wherein the central processor is a microprocessor based control unit.

19. The range unit of claim 18, wherein the operator interface further comprises an electronic touch pad.

20. The range unit of claim 19, wherein the electronic touch pad is a glass capacitive type touch pad.

21. The range unit of claim 17, wherein the plurality of heating elements further comprise:

a left rear burner;

a left front burner;

a right front burner;

a right rear burner;

a bridge burner; and, a warming zone.

22. The range unit of claim 21, wherein the first chamber is an oven.

23. The range unit of claim 22, wherein the second chamber is a warming drawer.

24. A method of operating a range comprising the steps of:

providing a body comprising a top surface, a first chamber located within the range, a second different chamber located within the range, a first heating means arranged on the top surface, wherein the first heating means provides a first type of heating, a second heating means arranged on the top surface, wherein the second heating means provides a second type of heating, a third heating means associated with the first chamber, wherein the third heating means provides a third type of heating, a fourth heating means associated with the second chamber, wherein the fourth heating means provides a fourth type of heating, an electronic control means comprising, an operator interface, a centralized processor, means for operatively connecting the operator interface to the centralized processor for the purpose of communicating with the centralized processor; and, means for operatively connecting the centralized processor with the first, second, third and fourth heating means for the purpose of communicating with the heating means, wherein at least one of the first, second, third, and fourth heating means operates on a duty cycle;

pressing a control button on the operator interface;

transmitting information to the central processing unit;

processing the information received from the operator interface through the central processing unit; and, turning on a heating means, wherein the operation of the heating means is dependent on a status of another heating means and, pressing a button on the operator interface; transmitting information to the central processing unit; processing information received from the operator interface through the central processing unit; and, turning on a heating means, wherein the operation of the heating means is independent of the status of another heating means.

25. The method of claim 24, wherein the heating means is the first heating means, the method further comprising the step of:

turning on at least one heating element, wherein the at least one element is a burner.

26. The method of claim 24, wherein the heating means is the third heating means, the method further comprising the step of:

turning on at least one heating element, wherein the at least one element is a baking and roasting element.

27. The method of claim 24, wherein the heating means is the third heating means, the method further comprising the step of:

turning on at least one heating element, wherein the at least one element is a broiling element.

28. The method of claim 24, wherein the heating means is the fourth heating means, the method further comprising the step of:

turning on at least one heating element, wherein the at least one element is a warming element.

* * * * *